US011473037B2

(12) United States Patent
Ives et al.

(10) Patent No.: US 11,473,037 B2
(45) Date of Patent: Oct. 18, 2022

(54) METHOD OF PRODUCING LIQUID SOAP FROM SOLID SOAP CONCENTRATE

(71) Applicants: Wendy Ives, Newfield, NY (US); Andrew Ives, Newfield, NY (US)

(72) Inventors: Wendy Ives, Newfield, NY (US); Andrew Ives, Newfield, NY (US)

(73) Assignee: Lucky Red Chicken, Inc., Newfield, NY (US)

( * ) Notice: Subject to any disclaimer, the term of this patent is extended or adjusted under 35 U.S.C. 154(b) by 379 days.

(21) Appl. No.: 16/899,168

(22) Filed: Jun. 11, 2020

(65) Prior Publication Data

US 2021/0388293 A1 Dec. 16, 2021

(51) Int. Cl.

| | |
|---|---|
| ***C11D 9/02*** | (2006.01) |
| ***C11D 13/26*** | (2006.01) |
| ***C11D 13/22*** | (2006.01) |
| ***C11D 13/12*** | (2006.01) |

(52) U.S. Cl.

CPC ..... *C11D 9/02* (2013.01); *C11D 13/12* (2013.01); *C11D 13/22* (2013.01); *C11D 13/26* (2013.01)

(58) Field of Classification Search

CPC ..... C11D 9/02; C11D 13/12; C11D 13/22; C11D 13/26; C11D 13/16; C11D 17/08

See application file for complete search history.

(56) References Cited

U.S. PATENT DOCUMENTS

| | | | |
|---|---|---|---|
| 4,879,063 | A | 11/1989 | Wood-Rethwill et al. |
| 5,378,242 | A | 1/1995 | Christie et al. |
| 8,685,908 | B2 | 4/2014 | Smith, III et al. |
| 9,193,942 | B2 | 11/2015 | Manning et al. |
| 9,844,524 | B2 | 12/2017 | Smith |
| 2007/0224228 | A1 | 9/2007 | Cockerell |
| 2008/0206167 | A1 | 8/2008 | Adler |
| 2016/0376526 | A1 | 12/2016 | Smith |
| 2018/0104206 | A1 | 4/2018 | Smith |

*Primary Examiner* — Deborah D Carr

(74) *Attorney, Agent, or Firm* — Thomas J. Germinario

(57) ABSTRACT

A two-stage method produces a liquid soap, having an alkaline pH and stable viscosity, so as to be efficacious in controlling pathogens and generating a thick lather which optimizes its cleansing and disinfecting effects. The method involves saponification of natural and/or synthetic oils/fats using of two lyes—potassium hydroxide and sodium hydroxide—which, when combined in roughly equal proportions, yield a lathery liquid soap without the need for synthetic surfactants or chemical thickeners. The method is also distinctive insofar as it first produces a solid soap concentrate, from which the liquid soap can be made simply by dissolving the solid soap concentrate in water.

4 Claims, No Drawings

METHOD OF PRODUCING LIQUID SOAP FROM SOLID SOAP CONCENTRATE

FIELD OF INVENTION

The present invention relates to the general field of soap products, and more particularly to methods of producing liquid soaps.

BACKGROUND OF THE INVENTION

In this age of recurring viral epidemics and pandemics, liquid hand soaps with anti-pathogenic properties have increased importance. Since high alkalinity environments are known to suppress the growth of pathogens, the use of alkaline lye constituents in soap making can contribute to the anti-pathogenic efficacy of soaps. At the same time, there are health and environmental reasons for preferring all-natural, organic liquid soap compositions, which can achieve the requisite pH and viscosity characteristics without the use of artificial additives.

SUMMARY OF THE INVENTION

The present invention is a method of producing a liquid soap, having an alkaline pH and stable viscosity, so as to be efficacious in controlling pathogens and generating a thick lather which optimizes its cleansing and disinfecting effects. The method involves saponification of oils/fats using of two lyes—potassium hydroxide and sodium hydroxide—which, when combined in roughly equal proportions, yield an optimal viscosity lathery liquid soap without the need for chemical thickeners or synthetic surfactants.

The method is also distinctive insofar as it first produces a solid soap concentrate, from which the liquid soap can be made simply by dissolving the solid concentrate in water. This feature not only reduces shipping expenses, but also enables the re-use of containers, thereby advantageously conserving resources.

The foregoing summarizes the general design features of the present invention. In the following sections, specific embodiments of the present invention will be described in some detail. These specific embodiments are intended to demonstrate the feasibility of implementing the present invention in accordance with the general design features discussed above. Therefore, the detailed descriptions of these embodiments are offered for illustrative and exemplary purposes only, and they are not intended to limit the scope either of the foregoing summary description or of the claims which follow.

DETAILED DESCRIPTION OF THE PREFERRED EMBODIMENT

The present invention is a two-stage method of producing a liquid soap. The first stage is the production of solid soap concentrate from a fatty constituent, two lye constituents and water. The fatty constituent consists of a combination of natural and/or synthetic fats, natural and/or synthetic oils, and/or fatty acids, while the lye constituents consist of potassium hydroxide (KOH) and sodium hydroxide (NaOH). While liquid soaps typically use only potassium hydroxide as the saponifying agent, the use of a roughly equal amount of sodium hydroxide in the instant formulation obviates the need for additional synthetic surfactants or thickening agents, such as chloride salts, to achieve a suitable and stable viscosity.

The preferred ranges for the solid soap concentrate constituents are 60-70% oils/fats, 20-30% water, and 5-10% each KOH and NaOH. The saponification of the oils/fats with the two-lye solution is conducted in a temperature range of 110-115° F., and the resulting neat soap is decanted, cooled for 3-4 hours, cut into solid soap concentrate pieces, and dried for 1-3 days. The solid soap concentrate pieces can be in any shape, including without limitation, bars or pellets. The solid soap concentrate is then packaged with directions by which an end user can convert the solid concentrate into a liquid soap, which conversion is the second stage of the method of the present invention.

The aims of the second stage method are simplicity and economy. Exemplary directions for the conversion process simply require the end user to cut a 5 oz. bar of the solid soap concentrate into 4-5 strips and insert the strips into an empty plastic 16 oz. liquid soap bottle containing tap water at room temperature (68°-72° F.), in which the solid soap concentrate will dissolve within 2-24 hours. The reuse of the plastic soap bottle is beneficial both economically and environmentally.

The concentrations of the two lyes in the soap concentrate produce a liquid soap with pH in the 8-9 range, so that the liquid soap has strong anti-pathogenic and antiseptic properties, without being caustic. The roughly equal presence of NaOH along with the conventional KOH in the double-lye constituents of the soap concentrate yields an optimal viscosity, which generates a thick lather conducive to thorough hand washing.

Although the preferred embodiment of the present invention has been disclosed for illustrative purposes, those skilled in the art will appreciate that many additions, modifications and substitutions are possible, without departing from the scope and spirit of the present invention as defined by the accompanying claims.

What is claimed is:

1. A method of producing a liquid soap from a solid soap concentrate, comprising the following steps:

(a) providing a constituent composition of the solid soap concentrate, consisting of (i) a fatty constituent, which consists of one or more fats, oils, fatty acids, or mixtures thereof, (ii) a first lye constituent, which consists of potassium hydroxide, (iii) a second lye constituent, which consists of sodium hydroxide, and (iv) water; wherein the constituent composition by weight consists of 60-70% of the fatty constituent, 5-10% of first lye constituent, 5-10% of the second lye constituent, and 20-30% of the water;

(b) dissolving the first lye constituent and the second lye constituent in the water to produce a lye solution;

(c) cooling the lye solution to 100°-115° F.;

(d) heating the fatty constituent to 100°-115° F.;

(e) saponifying the fatty constituent with the lye solution to produce a neat soap;

(f) decanting the neat soap to a soap mold and cooling to 110°-115° F.;

(g) dividing the neat soap to form multiple pieces of the solid soap concentrate and drying the pieces for 1-3 days;

(h) packaging the solid soap concentrate with consumer directions for a conversion process of the solid soap concentrate into a liquid soap, wherein the conversion process comprises dissolving the pieces of the solid soap concentrate in water; and (i) producing the liquid soap in accordance with the conversion process.

2. The method according to claim 1, wherein each of the pieces of the solid soap concentrate consists of a solid soap bar weighing 4-6 ounces, and wherein the conversion process directs that one of the solid soap bars be sliced into multiple strips and that the strips be dissolved in 15-20 ounces of tap water at room temperature during a period of 2-24 hours.

3. The method according to claim 2, wherein the conversion process directs that the strips of the solid soap bar be dissolved in the tap water within a re-usable container.

4. The method according to claim 1, wherein the liquid soap has a pH in the range of 8-9.

* * * * *